US005628194A

United States Patent [19]

Claudet

[11] Patent Number: 5,628,194

[45] Date of Patent: May 13, 1997

[54] PROCESS FOR PUMPING GASEOUS HELIUM AT CRYOGENIC TEMPERATURES BY A POSITIVE DISPLACEMENT PUMP

[75] Inventor: Gérard Claudet, La Tronche, France

[73] Assignee: Commissariat a l'Energie Atomique, Paris, France

[21] Appl. No.: 526,817

[22] Filed: Aug. 22, 1995

[30] Foreign Application Priority Data

Aug. 23, 1994 [FR] France ..... 94 10217

[51] Int. Cl.[6] ..... F17C 13/00

[52] U.S. Cl. ..... 62/50.6; 62/505; 418/55.2

[58] Field of Search ..... 62/50.6, 505; 418/55.2

[56] References Cited

U.S. PATENT DOCUMENTS 4,082,484 4/1978 McCullough ..... 418/55.2
4,328,684 5/1982 Leo .
4,382,754 5/1983 Shaffer ..... 418/55.2
4,490,099 12/1984 Terauchi et al. ..... 418/55.2
4,680,939 7/1987 Rojey et al. ..... 62/505
4,693,736 9/1987 Klusmier .
4,726,199 2/1988 Takano et al. ..... 62/505
4,831,828 5/1989 Klusmier et al. .
5,242,285 9/1993 Westermann, Jr. .

*Primary Examiner*—Ronald C. Caposella
*Attorney, Agent, or Firm*—Pearne, Gordon, McCoy & Granger

[57] ABSTRACT

Application of a positive displacement pump to the pumping of helium at very low temperatures. Positive displacement pumps, formed from mobile components (35, 36), which deliver gas volumes to pumping chambers, have the advantage of operating under satisfactory conditions for significant temperature, pressure and gas flow rate variations. They are therefore preferred as compared with the hitherto used centrifugal pumps and have means enabling them to operate at very low temperatures.

13 Claims, 2 Drawing Sheets

PROCESS FOR PUMPING GASEOUS HELIUM AT CRYOGENIC TEMPERATURES BY A POSITIVE DISPLACEMENT PUMP

DESCRIPTION

The present invention is defined by the application of a positive displacement pump to the pumping of gaseous helium at cryogenic temperatures. A positive displacement pump is mainly constituted by a fixed part and a mobile part, which together define a delivery volume into which the fluid is attracted and compressed by a reduction of said volume before passing out of the pump. It is therefore a virtually static compression, unlike in the case of turbomachines where the pressure results from a transformation of a kinetic energy, imparted to the gas by the blades, into pressure energy.

Helium is widely used in cryogenics due to its extremely low boiling point, helium being superfluid at 1.8K. However, this result is only achieved at a low pressure of approximately 15 millibars.

The evaporated helium must be withdrawn from the installation and renewed, at a flow rate which can be up to several dozen grams per second. The choice of a satisfactory pumping process is problematical under these conditions.

Thus, consideration has been given to the use of ordinary pumps, usable at temperatures close to ambient temperature, following heat exchangers through which the gases can reheat. However, it is difficult to construct heat exchangers without considerable pressure drops compared with the starting pressure and the density of the pumped gas is then very low. Therefore centrifugal pumps operating at low temperatures have been proposed, but the use characteristics of such pumps are only satisfactory for a given flow rate, which cannot be controlled in the present application because it is not possible to plan or rigidly forecast the operations performed in the installation and therefore the evaporation flow rate of the helium.

According to the invention, the gas is pumped at low temperature by a positive displacement pump, whose essential property here is to offer an adequate pumping flow rate, no matter what the incident gas flow rate.

The positive displacement pumps envisaged have the characteristic of being suitable for operating at low temperatures. The mobile parts responsible for the delivery of the gas are consequently designed with a clearance with respect to the fixed parts of the pump and constructions are chosen where the mobile parts are spirals, to the detriment of e.g. piston pumps, where significant friction is inevitable. Other means for the positive displacement pumps rendered necessary by the present application will be described hereinafter.

Figure 1:
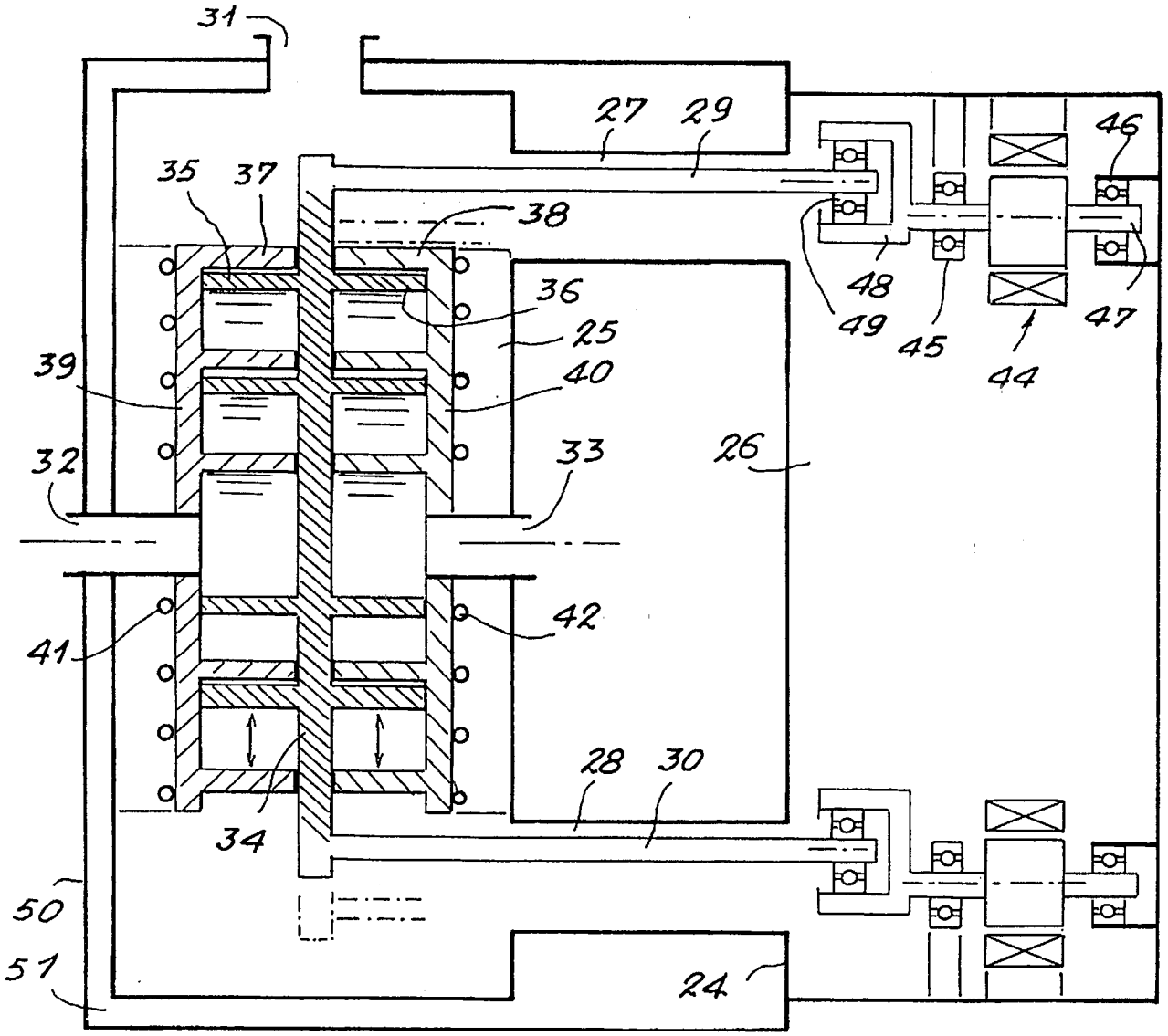

The invention is described in greater detail hereinafter in non-limitative manner and with reference to the attached drawings, wherein show:

FIG. 1 An embodiment of the invention.

Figure 1A:
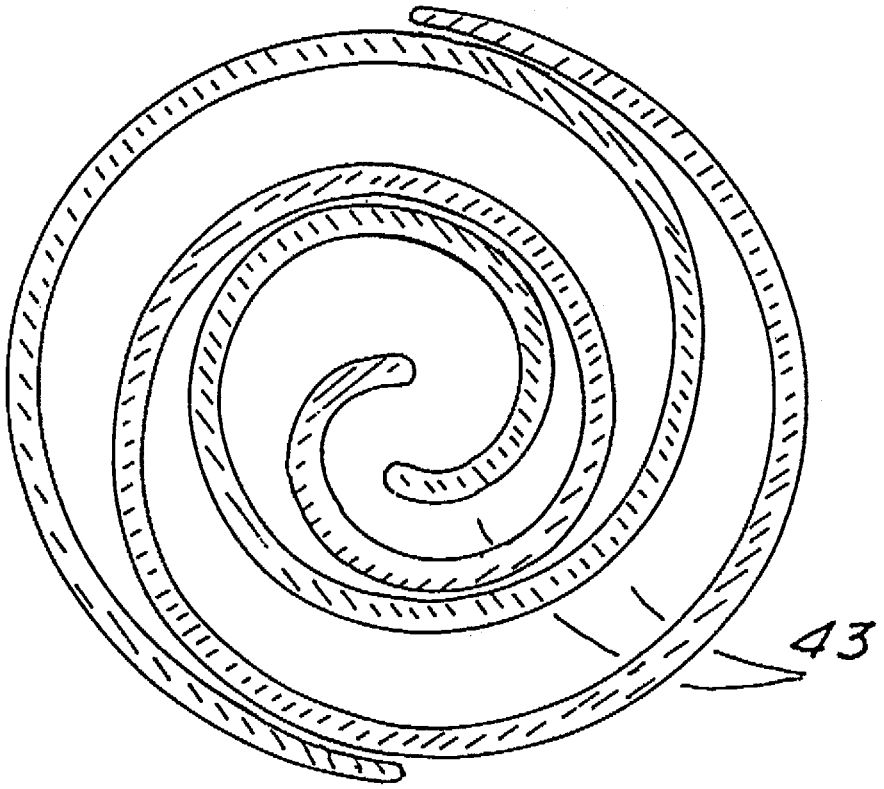

FIG. 1*a* The spirals of FIG. 1.

Reference will now be made to FIG. 1. The pump comprises a single box 24 subdivided into a pumping chamber 25 (cold) and a control chamber 26 (hot) interconnected by two tubular junctions 27, 28 of the box 24, which provide a passage for the two control shafts 29, 30. The tubular junctions 27, 28 and control shafts 29, 30 are thermally insulating, so as to allow no significant passage of heat by conduction between the chambers 25 and 26. A gas intake 31 issues into the pumping chamber 25 by its periphery and two outlets 32, 33, which it is then possible to connect by ducts, lead into the axis of the pumping chamber 25.

The control shafts 29, 30 carry a plate 34 from whose two faces rise mobile spirals 35, 36. These spirals 35, 36 are mobile in fixed spirals 37, 38 connected to fixed plates 39, 40 centrally traversed by outlets 32, 33 and cooled by coils 41, 42 if an isothermal compression is desired.

Spirals 35, 38 are identical, but the mobile spirals 35, 36 are displaced with respect to the fixed spirals 37, 38 and perform a circular trajectory therein. Therefore the fixed and mobile spirals define crescent-shaped delivery volumes 43 (FIG. 1*a*), which are compressed and displaced towards the centre. The gas rushing in through the intake 31 slides into the delivery volumes 43 passing between the mobile plate 34 and the edges of the fixed spirals 37, 38 and therefore advances between the spirals and the plates up to the outlets 32, 33. There is a clearance between the fixed spirals 37, 38 and mobile spirals 35, 36, so that no lubricant is necessary.

The members located in the control chamber 26 can be components provided for operation at normal temperature. With each of the control shafts 29, 30 is associated a motor 44, ball bearings 45, 46 for supporting the output shaft 47 of the motor 44, and a cam 48 at one end of the output shaft 47, which carries a final ball bearing 49, in which is engaged the end of the control shaft 29 or 30. The two motors 44 are synchronized by a not shown servomechanism and whose design is obvious to the expert. As a variant, it would be possible to use a single motor and then the cams 48 would be interconnected. In all cases, the cams 48 ensure the circular displacement of the control shafts 29, 30 and the plate 34.

It can be seen that the arrangement of the plate 34 supported by two overhanging shafts avoids the use of magnetic bearings immersed in the pumping chamber 25.

An outer enclosure 50 surrounds the box 24 (except at the location of the control chamber 26 projecting beyond the same) in order to define a vacuum cavity 51 surrounding the pumping chamber 25 and thus ensuring a good insulation of the machine.

The coils 42, 44 welded to the spirals could be replaced by ducts hollowed out within the grooves and having the same effect.

According to the invention, the term spiral is used to define any shape, which is in particular wound onto itself and able to form with another spiral virtually closed volumes moving from one end to the other of one of said spirals in fixed form when the other of these spirals makes a periodic and in particular circular movement.

I claim:

1. Process for pumping evaporated gaseous helium at cryogenic temperatures, characterized by the steps of selecting a positive displacement pump comprising a spiral fixed part (37, 38, 39, 40) and a spiral mobile part (35, 36), the fixed part and the mobile part being constructed with intermediate clearances avoiding any friction and provided with a pump cooling device (41, 42); cooling the spiral parts with the cooling device; rotating the spiral mobile part with respect to the fixed part in order to define therewith a delivery volume; attracting the helium into the delivery volume; compressing the helium by a decrease of said volume; and subsequently passing the helium out of the pump.

2. Pumping process according to claim 1, characterized in that the mobile part is supported by a driving shaft (29, 30) passing through a thermal separation wall (24, 27, 28)

between a cold region (25) occupied by the mobile part and a hotter region (26) occupied by a motor (44) driving the driving shaft, the thermal separation wall and the driving shaft, at least between the two regions, being made from a thermally insulating material.

3. Pumping process according to claim 2, characterized in that driving shaft is supported by a bearing (49) in the hotter region.

4. Pumping process according to claim 3, characterized in that the driving shaft is only supported by the bearing (49) and has no support in the cold region.

5. A process for pumping evaporated gaseous helium at cryogenic temperatures, comprising the steps of selecting a scroll type pump comprising a stationary spiral part and a mobile spiral part used for said pumping, the stationary spiral part being separated from the mobile spiral part with clearances; moving the mobile spiral part along a circular trajectory with respect to the stationary spiral part so as to displace said gaseous helium; and cooling said spiral parts.

6. A process according to claim 5, further comprising the steps of locating the pump in a warmer volume and moving the mobile spiral part in a colder volume by a motor having at least one driving shaft passing through a thermal separation wall separating said colder and warmer volumes.

7. A process according to claim 6, further comprising the step of moving the spiral part through two parallel driving shafts moved along the circular trajectory through respective synchronized cams.

8. A process according to claim 6, wherein the driving shaft is supported by bearings present in the warmer volume only.

9. A process according to claim 5, wherein the mobile and spiral parts are thermally insulated with a surrounding enclosure comprising a vacuum cavity.

10. A cryogenic gaseous helium pump comprising:

a spiral fixed part;

a spiral mobile part, the fixed part and the mobile part being constructed with intermediate clearances avoiding any friction, the mobile part being rotatable with respect to the fixed part to define therewith a delivery volume into which the helium is attracted and compressed by a decrease of said volume before the helium is passed out of the pump; and a pump cooling device disposed on the fixed part.

11. Pump according to claim 10, characterized in that the mobile part is supported by a driving shaft (29, 30) passing through a thermal separation wall (24, 27, 28) between a cold region (25) occupied by the mobile part and a hotter region (26) occupied by a motor (44) driving the driving shaft, the thermal separation wall and the driving shaft, at least between the two regions, being made from a thermally insulating material.

12. Pump according to claim 11, characterized in that the driving shaft is supported by a bearing (49) in the hotter region.

13. Pump according to claim 12, characterized in that the driving shaft is only supported by the bearing (49) and has no support in the cold region.

* * * * *